US005197306A

United States Patent [19]

Yamakita

[11] Patent Number: 5,197,306

[45] Date of Patent: Mar. 30, 1993

[54] STEAMER FOR PROCESSING DYED LONG STRIP OF FABRIC

[75] Inventor: Yoshimichi Yamakita, Toyama, Japan

[73] Assignee: Yoshida Kogyo K.K., Tokyo, Japan

[21] Appl. No.: 778,656

[22] Filed: Oct. 18, 1991

[30] Foreign Application Priority Data

Oct. 19, 1990 [JP] Japan ..... 2-280637

[51] Int. Cl.[5] ..... D06B 23/30

[52] U.S. Cl. ..... 68/5 D; 68/205 R; 68/5 E; 134/104.1; 118/70

[58] Field of Search ..... 68/5 D, 5 E, 5 C, 205 R; 134/104.1; 118/70

[56] References Cited

U.S. PATENT DOCUMENTS

| | | | |
|---|---|---|---|
| 3,901,053 | 8/1975 | Meisen et al. | 68/5 D |
| 3,916,475 | 11/1975 | Wilford . | |
| 3,950,802 | 4/1976 | Schiffer et al. | 68/205 R |
| 4,004,879 | 1/1977 | Windhorst et al. | 68/205 R X |
| 4,164,051 | 8/1979 | Sando et al. | 68/5 D |
| 4,211,094 | 7/1980 | Meisen | 68/5 D |
| 4,571,962 | 2/1986 | Sando et al. | 118/70 |

FOREIGN PATENT DOCUMENTS

| | | | |
|---|---|---|---|
| 0312823 | 4/1989 | European Pat. Off. . | |
| 2752057 | 6/1978 | Fed. Rep. of Germany | 68/5 E |
| 2058884 | 5/1971 | France . | |
| 50-33190 | 10/1975 | Japan | 68/5 D |
| 2031305A | 4/1980 | United Kingdom . | |

*Primary Examiner*—Frankie L. Stinson

*Attorney, Agent, or Firm*—Hill, Steadman & Simpson

[57] ABSTRACT

In a steamer, a dyed long strip of fabric is spirally guided on guide rollers in a steamy atmosphere to develop and set dye colors, being brought out as a dyed product. Dyes adhering on the guide rollers are washed by washing units so that clean surfaces of the guide roller contact with the dyed fabric strip.

3 Claims, 3 Drawing Sheets

STEAMER FOR PROCESSING DYED LONG STRIP OF FABRIC

BACKGROUND OF THE INVENTION

1. Field of the Invention

This invention relates to a steamer suitable for processing a dyed strip of fabric, and more particularly to a steamer for continuously processing a long narrow strip of fabric which is sectionally dyed in different colors.

2. Description of the Related Art

Heretofore steam processing of dyed fabric is extensively used to develop and set the dyes, since this processing can be performed speedily without interruption.

The steam processing is carried out in a sealed steamer. A dyed long strip of fabric is brought into the sealed steamer, guided therethrough for a preset period of time, and then drawn out of the steamer. The dyes are developed and set on the fabric while it runs in the steamer.

There are two typical methods for running the dyed fabric. In one of them, a great number of guide rollers are arranged in a staggered manner at the upper and lower parts of the steamer. A dyed long fabric strip is brought into the steamer via an inlet, being guided around the guide rollers in a zig-zag course to be drawn out via an outlet.

In the other method, a plurality of guide rollers are spirally arranged in the steamer between its inlet and outlet so that the dyed fabric strip is spirally guided on these guide rollers in the steamer.

With these methods, the steamers are very compact and can assure reliable steam processing of the dyed fabric strip in the preset period of time.

Recently there are demands for production of a good assortment of long fabric strips in a small amount. To satisfy such demands, it is necessary to dye a fabric strip in one color to a desired length and then in different colors.

Conventionally, a fabric strip dyed in one color and another fabric strip dyed with a different color are connected by a piece of guide cloth having a preset length, being guided into a steamer to be processed continuously. The guide cloth is used to absorb a first dye adhering to the guide rollers and to prevent a second dye from being mixed with the first dye on the fabric strip.

With the former method in which the dyed fabric strip is moved in a zigzag course, the fabric strip contacts the guide roller surfaces with an angle of 180° or more. The surfaces of the guide rollers are so extensively stained by the dye of the fabric strip that a great amount of a washing liquid should be used to clean the guide rollers.

In this method, both the front and rear surfaces of the dyed fabric strip alternately contact with the upper and lower guide rollers with a relatively strong force. When a dyed fabric strip has fine projections on its one surface such as pile elements of a surface fastener and coupling elements of a fastener chain, these fine projections would be pressed and deformed by the rollers, making the product worthless.

The latter method in which the dyed fabric strip is moved in the spiral course can solve the inconveniences of the first method to a degree. However, it is inevitable to connect the color changed portions of the dyed fabric strip by pieces of guide cloth, or to discard color-mixed portions to a preset length. When the fabric strip is sectionally dyed in various colors, the guide rollers would be so extensively stained that the steamer should be frequently washed and cleaned by interrupting its operation.

SUMMARY OF THE INVENTION

It is therefore an object of this invention to provide a steamer which employs the spiral running system, continuously and efficiently processes the fabric strip dyed in different colors, and prevent the guide rollers from being stained by the dyes.

According to this invention, there is provided a steamer for processing long strip of fabric to develop and set dye colors, comprising: a housing having an inlet and an outlet for bringing in and out a dyed long strip of fabric; a plurality of rollers arranged in the housing to spirally guide the dyed long fabric strip between the inlet and the outlet; a plurality of washing units positioned near the rollers, being adapted to apply washing liquid and to wash surfaces of the rollers when the fabric strip dyed in one color is changed to another color or at a preset timing; and a plurality of troughs for receiving the washing liquid, being positioned under the rollers and washing units, and discharging the used washing liquid outwardly.

A fabric strip dyed in a preceding stage is continuously brought into a steamer via an inlet. The fabric strip is spirally guided on the guide rollers, color-developed and set by the steam in the steamer, and brought out via an outlet.

When a fabric strip is dyed in one color to a preset length, it is automatically dyed in a different color. A running length of the dyed fabric strip is detected based on the amount of rotation of the guide rollers. The length of the fabric strip dyed in the first color is informed to washing units in the steamer via a controller. When a color-changed portion of the fabric strip passes on the guide rollers, the washing units are set in motion to wash the surfaces of the guide rollers. The used washing liquid is discharged via troughs under the guide rollers.

DETAILED DESCRIPTION

An embodiment of this invention will now be described with reference to the accompanying drawings.

A steamer 1 is a sealed vessel having walls 2, being applied steam. To bring in and out a dyed fabric strip, the steamer 1 has an inlet 4 and outlet 5 at its lower front side and rear bottom center, respectively. The inlet 4 is sealed by a sealing member (not shown), and the outlet 5 is sealed by a water seal 5-1.

Figure 3:
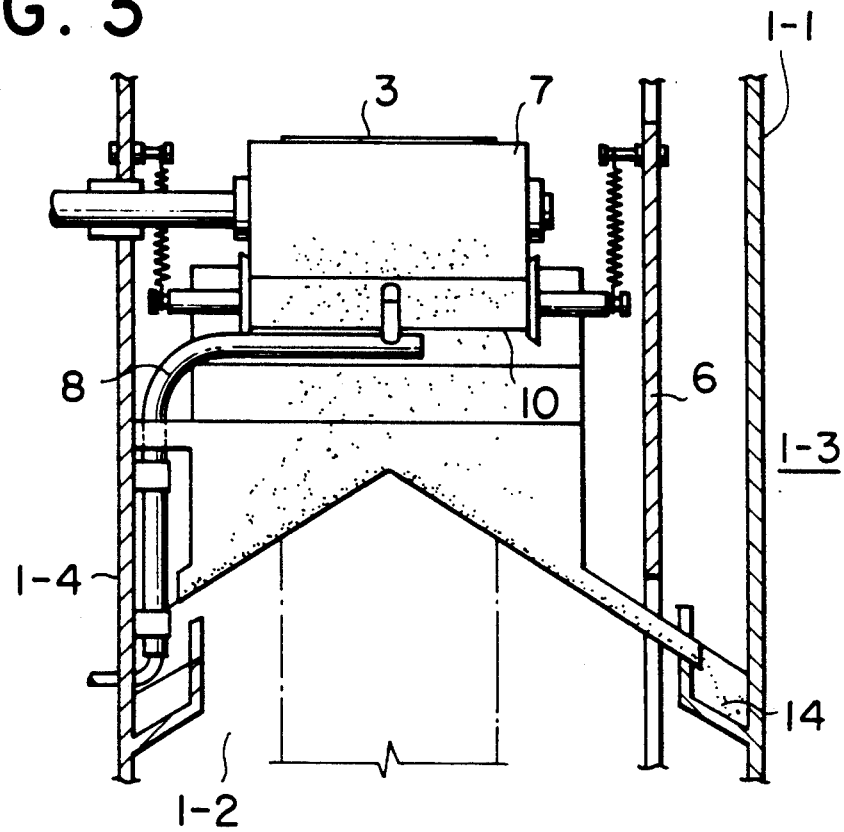
FIG. 3 is a side elevational view of the steamer.

The interior of the steamer 1 is divided into front and rear rooms 1-2, 1-3 by an intermediate wall 1—1 as shown in FIG. 3. A substantially X-shaped brace 6 is erected near the intermediate wall 1—1. A plurality of guide rollers 7 are rotatably supported by roller shafts connected to a front wall 1-4 along the brace 6. In other words, the guide rollers 7 are also arranged in substantially X-shaped configuration.

The dyed fabric strip 3 is brought into the front room 1-2 via the inlet 3, guided from the outer guide rollers 7 to the inner guide rollers 7 to reach the center of the steamer 1, and then directed outside via the outlet 5. Specifically, the dyed fabric strip 3 spirally runs from the inner peripheral area of the front room 1-2 toward the center of the steamer 1.

In this embodiment, all of the guide rollers 7 are set in motion by driving means such as a motor. It is also possible to drive every two guide rollers in combination with the driving means.

The guide rollers 7 are supported on the front wall 1-4 by cantilevers in this embodiment to facilitate initial setting of the dyed fabric strip 3 on the guide rollers 7 in the steamer 1. For this purpose, the intermediate wall 1—1 can be opened and closed as desired. It is needless to say that the guide rollers may be supported by opposite ends thereof if some suitable measures are taken to reliably set the dyed fabric strip on the guide rollers.

A plurality of washing nozzles 8 are respectively mounted below and above the guide rollers 7 which are positioned at the upper and lower portions of the X-shaped brace 6. The nozzles 8 are arranged to confront their associated guide rollers 7. The washing nozzles 8 may be in any shape. In this embodiment, the nozzles 8 are hook-shaped members extending from the closed end of a pipe. A number of apertures may be formed on the straight portion of the pipe, for example.

To wipe the washing liquid off from the surface of the guide rollers 7, a plurality of squeeze rollers 10 are positioned in close contact with the guide rollers 7 near the nozzles 8 and in parallel to the roller shafts.

Figure 1:
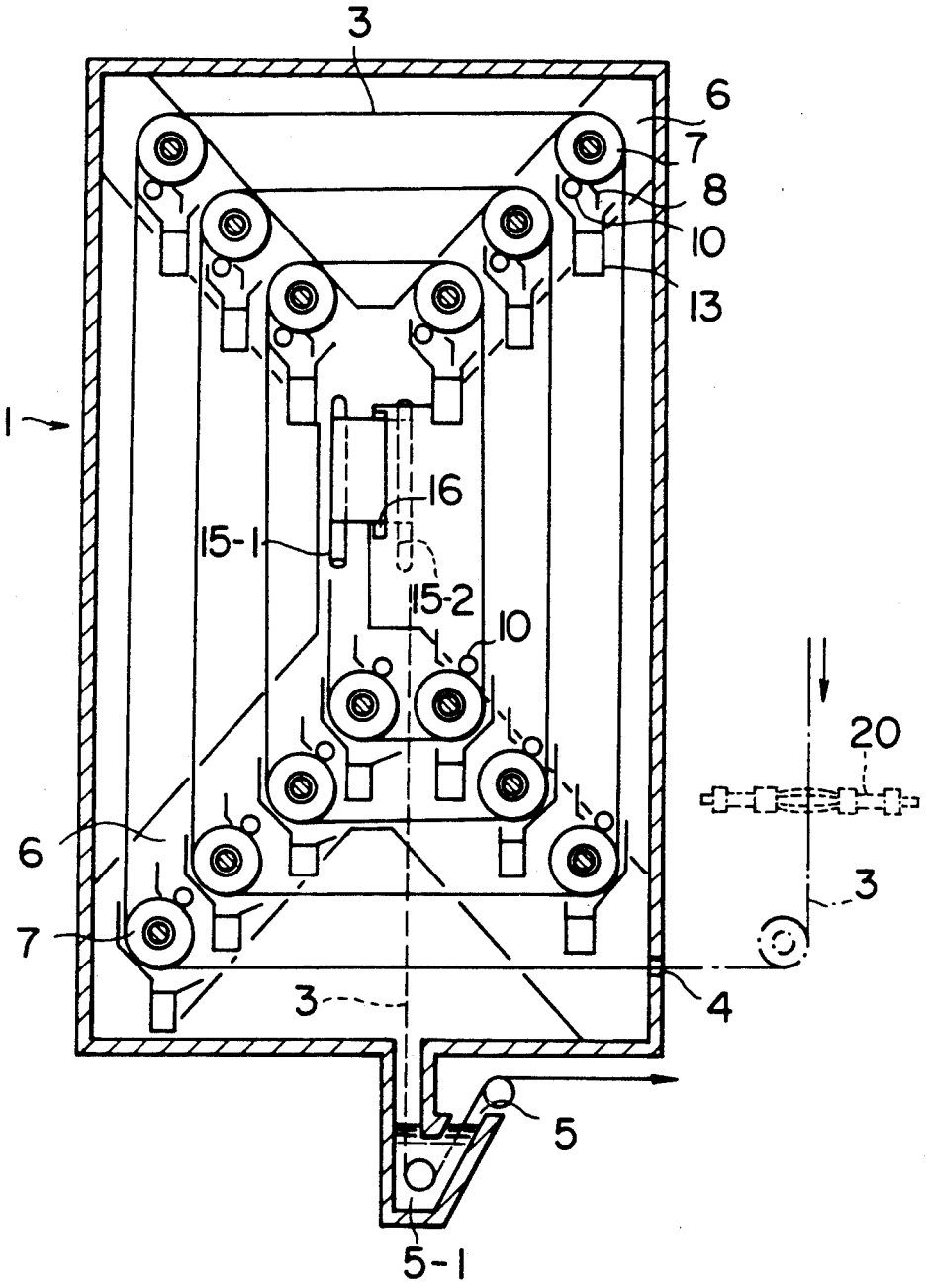
FIG. 1 is a front view showing arrangement of rollers in a steamer according to an embodiment of this invention.
Figure 2:
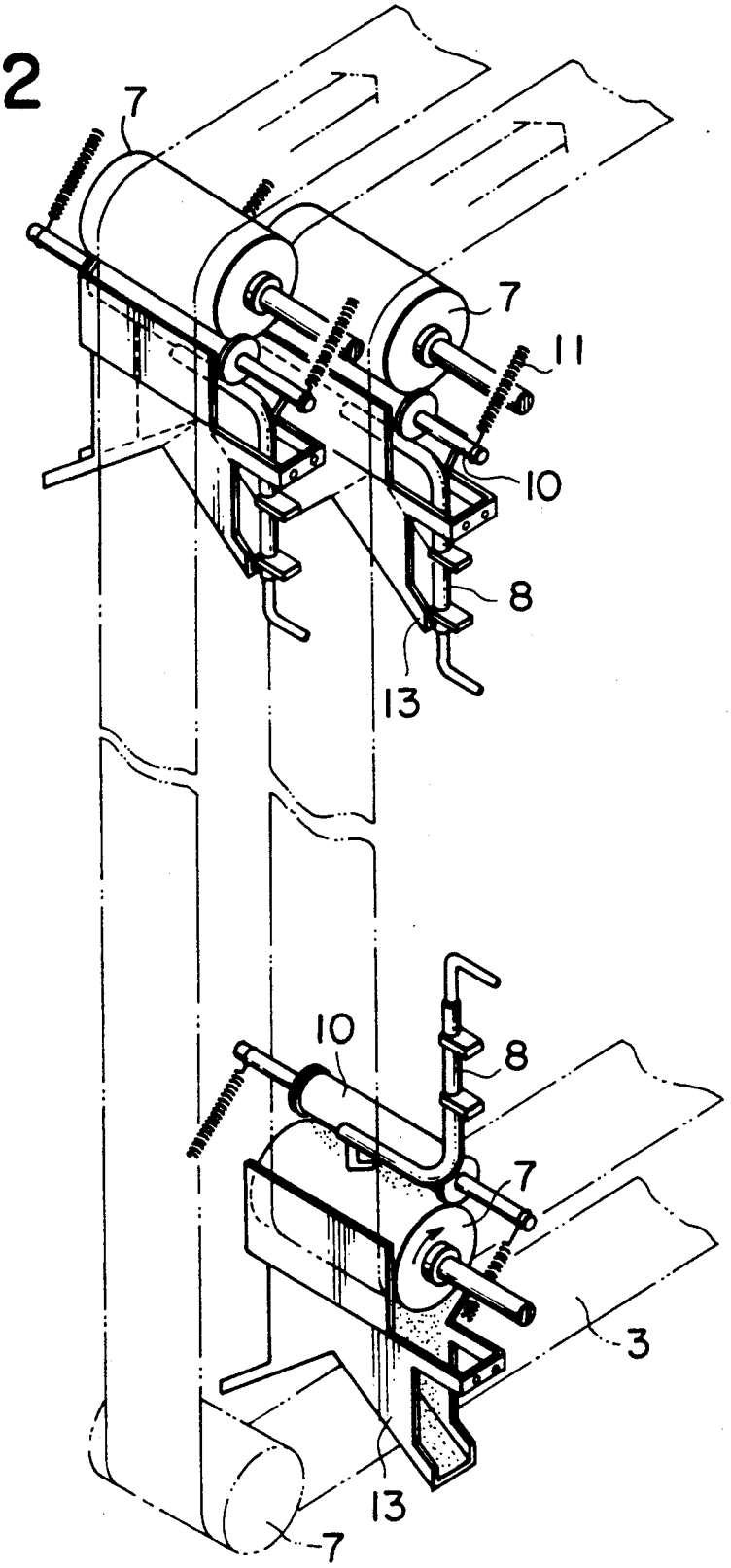
FIG. 2 is a perspective view partially showing the interior of the steamer.

In the embodiment shown in FIGS. 2 and 3, each squeeze roller 7 is as wide as each guide roller 7, having flanges at its opposite ends to prevent lateral scattering of the washing liquid. The opposite ends of the squeeze rollers 10 are connected to tension springs 11 whose the other ends are connected to the brace 6 and the front wall 1-4. The squeeze rollers 10 are in pressure contact with the guide rollers 7 by the tension springs 11. In other words, the squeeze rollers 10 are suspended by the tension springs 11.

Figure 4:
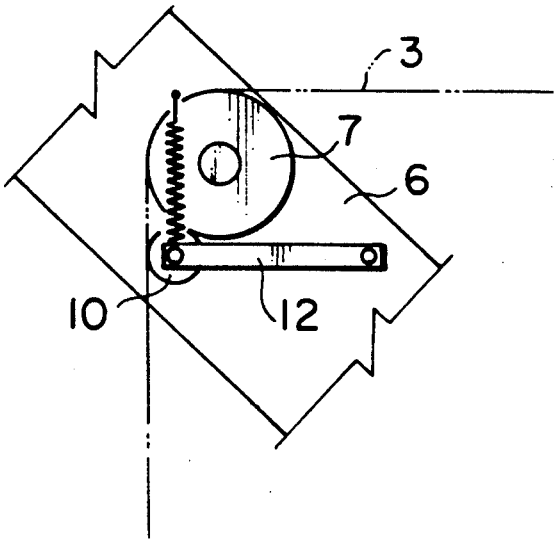
FIG. 4 is a front view showing a modification of a squeeze roller support.

FIG. 4 shows a modification of the structure for supporting the squeeze rollers 10. One end each of the squeeze rollers 10 is coupled to one end each of cross arms 12 which are rotatably supported on the brace 6, so that the squeeze rollers 10 are rotatably supported.

A plurality of troughs 13 are positioned below the guide rollers 7 to discharge the wiped washing liquid outside the steamer 1. As shown in FIGS. 2 and 3, the troughs 13 are laterally and downwardly slanted to conduct the washing liquid wiped by the squeeze rollers 10. A drain channel 14 is positioned near the ends of the troughs 13, discharging the washing liquid outwardly.

The brace 6 has a cutaway at its central portion. In the cutaway, a lever 15-1 for changing the direction of the dyed fabric strip 3 is erected with 45° toward the brace 6 at the rising end portion of the spiral running path of the dyed fabric strip 3. A bar 15-2 with tilt of 45° is erected in the rear room 1-3. The bar 15-2 is symmetrical to the lever 15-1 with respect to the intermediate wall 1—1. The dyed fabric strip 3 running spirally over the guide rollers 7 is passed through a slit 16 of the intermediate room 1—1 and via the bar 15-2 of the rear room 1-3 so that the moving direction of the fabric strip 3 is changed 180°, being guided downwardly to the outlet 5 to be discharged outwardly via the water seal 5-1.

When the fabric strip is spray-dyed in one color to the preset length before the fabric strip is guided into the steamer and the dye in the nozzle 20 is changed to a new dye by suitable means and sprayed to the fabric strip, the washing liquid is injected to the guide rollers 7 from the washing nozzles 8 at a preset timing in response to change of the dye color. Thereby the rollers adhered with the preceding dye are automatically washed. The timing to perform this is just before the fabric strip dyed in a new color reaches the guide rollers.

In the foregoing embodiment, a control unit (not shown) is used. A detector (not shown) detects the running length of the fabric strip 3 based on the number of rotations of the guide roller 7 which is nearest the inlet 4. The control unit determines time lag to operate the washing nozzles 8 according to a signal from the detector to wash the guide rollers 7 in succession. This invention is not limited to timing control of the detector and the washing process. It is necessary to operate the washing nozzles 8 at a proper timing so that the preceding dye of the fabric strip does not mix with the succeeding dye by the guide rollers 7.

This invention is applicable not only to the long narrow strip of fabric such as fasteners but also to ordinary strips of fabric.

The guide rollers may be washed by washing liquid which overflows from the interior of these rollers in addition to use of the washing nozzles.

According to this invention, a plurality of the guide rollers and washing nozzles are arranged so that the dyed long fabric strip is spirally guided on the guide rollers. When a color changed portion of the fabric strip passes over the guide rollers, the guide rollers are automatically washed. The dyed fabric strip contacts the surfaces of the guide rollers with a small angle so that the rollers are barely stained by the dyes, and a little washing liquid is consumed to wash the guide rollers.

With the spiral running method, only one side of the dyed fabric is contacted with the guide rollers. Sometimes a fabric strip has fine projections on its one surface such as a surface fastener and a fastener chain having coiled coupling element rows. The fabric strip can be guided on the guide rollers without such surface contacting with the guide rollers, so that such fine projections will not be damaged or deformed, and keeping the product worthy.

What is claimed is:

1. A steamer for processing long strip of fabric to develop and set dye colors, comprising:

(a) a housing having an inlet and an outlet for bringing in and out a dyed long strip of fabric;

(b) a plurality of guide rollers arranged in said housing to spirally guide the dyed long fabric strip between said inlet and said outlet;

(c) a plurality of washing nozzles respectively mounted below and above said guide rollers to confront said guide rollers, being adapted to apply washing liquid and to wash surfaces of said rollers when the fabric strip dyed in one color is changed to another color or at a preset timing;

(d) a plurality of squeeze rollers positioned in close contact with said guide rollers; and (e) a plurality of troughs for receiving the washing liquid, being positioned under said rollers and washing units, and discharging the used washing liquid outwardly.

2. A steamer according to claim 1, wherein said squeeze rollers are in pressure contact with the surfaces of said guide rollers by pairs of tension springs.

3. A steamer according to claim 1, wherein a plurality of drain channels are disposed on inner faces of a front wall of said housing and on an intermediate wall disposed inside of said housing and can be opened and closed as desired so that said drain channels receive said washing liquid dropping from said troughs and discharge it outwardly.

* * * * *